United States Patent [19]

Yoshida et al.

[11] 4,188,982

[45] Feb. 19, 1980

[54] WOVEN FASTENER STRINGER

[75] Inventors: Hiroshi Yoshida; Noritaka Tsubata, both of Uozu, Japan

[73] Assignee: Yoshida Kogyo K.K., Tokyo, Japan

[21] Appl. No.: 971,992

[22] Filed: Dec. 21, 1978

[30] Foreign Application Priority Data

Dec. 29, 1977 [JP] Japan ..... 52-5387

[51] Int. Cl.[2] ..... D03D 41/00

[52] U.S. Cl. ..... 139/384 B; 24/205.16 C

[58] Field of Search ..... 139/384 B; 24/205.01 C, 24/205.13 C, 205.16 C

[56] References Cited

U.S. PATENT DOCUMENTS

| | | | |
|---|---|---|---|
| 3,807,462 | 4/1974 | Nogai | 139/384 B |
| 3,901,291 | 8/1975 | Nogai | 139/384 B |
| 3,921,679 | 11/1975 | Glindmeyer et al. | 139/384 B |
| 3,941,163 | 3/1976 | Glindmeyer et al. | 139/384 B |
| 3,976,106 | 8/1976 | Porepp | 139/384 B |

FOREIGN PATENT DOCUMENTS

| | | | |
|---|---|---|---|
| 2333152 | 1/1975 | Fed. Rep. of Germany | 139/384 B |
| 50-85445 | 7/1975 | Japan | 139/384 B |

*Primary Examiner*—Henry Jaudon

*Attorney, Agent, or Firm*—Bucknam and Archer

[57] ABSTRACT

A woven stringer tape for a slide fastener has a row of interconnected coupling loops mounted on an edge of the tape by a plurality of binding warp threads extending longitudinally over an upper leg of each of the successive loops and a binding weft thread interlaced with the binding warp threads. Selected foundation warp threads underlying a lower leg of the loop are passed upwardly toward the upper legs between each adjacent pair of loops and interlaced with the binding weft thread in substantially the same plane where the binding warp threads are interlaced with the binding weft thread.

4 Claims, 5 Drawing Figures

WOVEN FASTENER STRINGER

BACKGROUND OF THE INVENTION

1. Field of the Invention

This invention relates to a slide fastener, and more particularly to a fastener stringer having a continuous plastic filament spirally formed and woven into an edge of a stringer tape during the weaving thereof by a needle loom.

2. Prior Art

There have been proposed a number of slide fasteners or zippers of the type described, which comprise a woven stringer tape and a plastic filament woven into a longitudinal edge of the tape, the filament being usually formed into a helical coil structure consisting of a succession of loops or elongated convolutions each having a coupling head, an upper and a lower leg and a connecting portion.

Most of the known fasteners, however, have failed to meet with the requirements for the success of the so-called woven slide fasteners which largely depends upon the positional stability of the filament, i.e. coupling fastener element, with respect to the stringer tape against external stresses. When subjected to severe bending stresses in the transverse direction, the warp threads in particular holding the filament onto the tape are apt to shift out of place either toward the coupling head or toward the connecting or heel portion, which would in turn obstruct the movement of the slider and make it difficult to couple and uncouple the cooperating stringers.

SUMMARY OF THE INVENTION

According to the invention, there is provided, a woven fastener stringer comprising a woven tape formed with foundation warp and weft threads and consisting of a web section defining a major dimension of said tape and a woven filament section defining a longitudinal edge portion of said tape; a row of successively interconnected elongated loops woven into said filament section, each of said loops having a coupling head at one end thereof, an upper leg and a lower leg extending from said head in a common direction and a heel portion at the opposite end remote from said head connected to a next adjacent one of said successive loops; a plurality of reinforcing cores extending longitudinally through said row of elongated loops; a binding weft thread extending substantially the full length of said leg between each adjacent pair of said loops; a first group of binding warp threads and a second group of binding warp threads both being interlaced with said binding weft thread substantially in a common place defined by the upper surfaces of said upper legs, said first group of threads being further interlaced with said foundation weft thread underlying said lower legs of said loops, and one or more of said foundation warp threads in said woven filament section passing upwardly towards said upper legs and being interlaced with said binding weft thread.

It is therefore an object of the present invention to provide a slide fastener stringer which will eliminate the foregoing difficulties of the prior art.

A more specific object of the invention is to provide such a fastener stringer which has warp threads stably anchored in place against bending stresses so that the coupling filament is maintained in the proper position on the stringer tape.

Another specific object of the invention is to provide a fastener stringer having a coupling filament woven in such a manner that either of the two stringer faces can be optionally used.

Many other advantages and features of the present invention will become manifest to those versed in the art upon making reference to the detailed description and the accompanying sheets of drawings in which preferred structural embodiments incorporating the principles of the present invention are shown by way of example.

BRIEF DESCRIPTION OF THE DRAWINGS

In the drawings wherein like reference numerals refer to like parts.

DETAILED DESCRIPTION OF THE PREFERRED EMBODIMENTS

Figure 1:
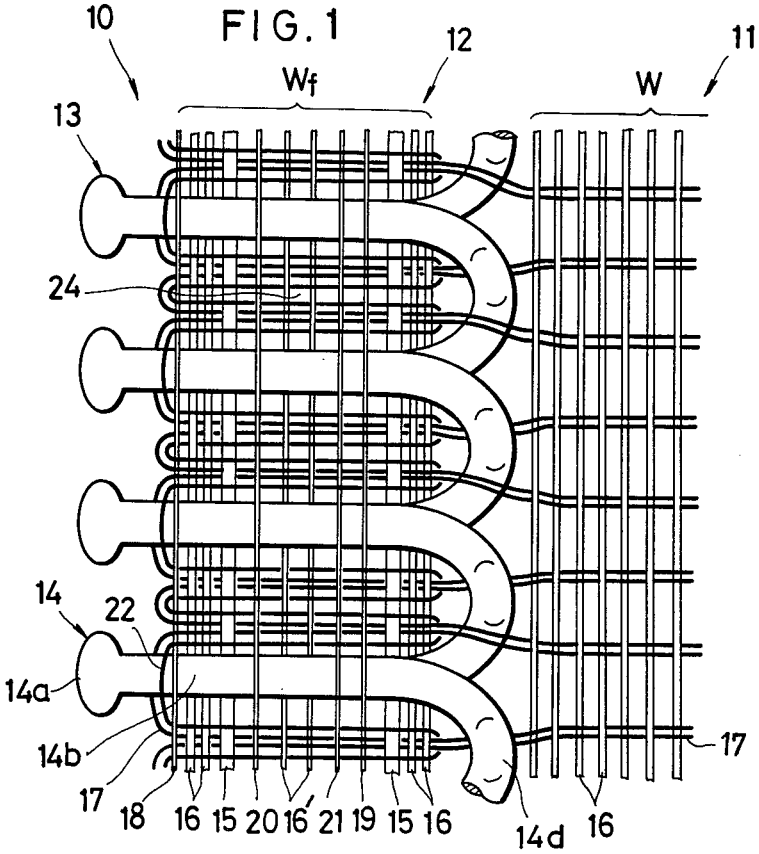
FIG. 1 is a plan view on enlarged scale of a portion of one of two identical fastener stringers according to one embodiment of the invention.
Figure 2:
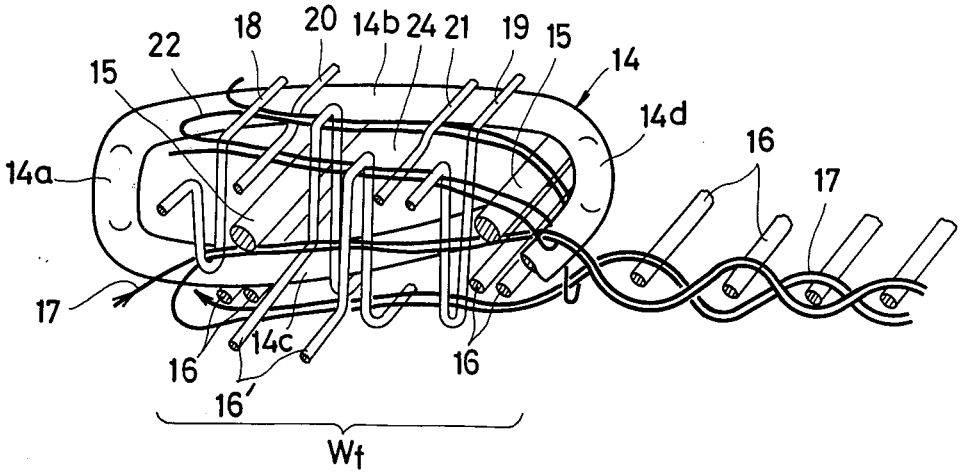
FIG. 2 is a diagrammatic, partly sectional, perspective view of a segment of the portion of the fastener stringer shown in FIG. 1.
Figure 3:
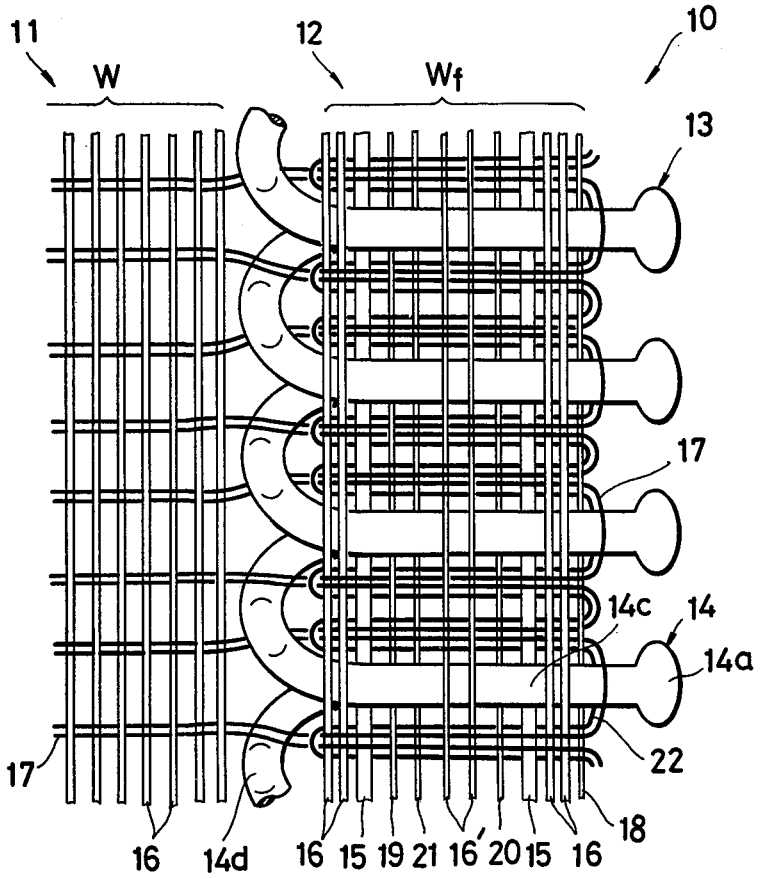
FIG. 3 is a view of the reverse side of the stringer shown in FIG. 1.

Referring now to FIGS. 1–3 inclusive, which illustrate a first preferred embodiment of the invention, there is shown a fastener stringer generally designated 10 which constitute one part of a pair or two identical stringers for a slide fastener. The stringer 10 consists of a generally flat web section W defining a major dimension of a woven tape 11 and a woven filament section $W_f$ defining a longitudinal edge portion 12 into which a filament 13 of plastic material is woven. The filament 13 is formed from a linear blank of a suitable plastic material into a helically coiled structure having a succession of loops or elongated convolutions. This is done during the course of weaving of the tape 11, for example in the manner disclosed in Japanese Laid-Open Publication No. 50-36250.

Each loop or elongated convolution 14 in the filament 13 has a coupling head **14*a* at one end thereof, an upper leg 14*b* and a lower leg 14*c* extending from the head 14*a* in a common direction and a heel portion 14*d* at the opposite end remote from the head 14*a* connected to a next adjacent one of the successive loops 14. The coupling head 14*a* is dimensioned to releasably couple with a corresponding head of a loop 14 on a mating stringer to open and close the fastener in the well known manner. The upper and lower legs 14*b* and 14*c* are spaced apart in substantially superimposed relation to each other as shown in FIGS. 1 and 3 and define therebetween a longitudinally extending "tunnel" or hollow conduit through which a reinforcing string, cord or core 15** is inserted.

The web section W of the tape 11 may be of any known design having foundation warp threads 16 and foundation weft thread 17 interwoven in a variety of patterns, which will require no further explanation as this has no direct bearing upon the invention.

The term "filament woven section $W_f$" is used to define a longitudinal edge portion of the tape 11 into which the filament 13 serving as a coupling element for a slide fastener is woven. In addition to the foundation warp and weft system in the filament woven section $W_f$, there are provided a first group of binding warp threads 18 and 19 and a second group of binding warp threads 20 and 21 and a continuous binding weft thread 22 cooperating with the binding warp threads 18–21 in binding or anchoring the filament 13 firmly in place on the stringer tape 11. The binding warp threads 18–21 extend longitudinally of the tape 11 in parallel relation to one another and in interlaced relation to the binding weft thread 22. The threads 18–21 all overlie the upper legs **14*b* of the loops 14. The first group of binding warp threads 18 and 19 extend along a relatively deep undulation path, while the second group of binding warp threads 20 and 21 extend along a relatively shallow undulation path, as better shown in FIG. 2**, for reasons hereafter explained.

Each of the successive loops 14 of the coupling filament 13 has its lower leg **14*c* secured by the foundation warp threads 16, 16' and weft 17 onto the woven filament section $W_f$. To further stabilize the fixation of the lower leg 14*c* to the tape 11, the foundation weft 17 is interlaced with the first group of binding warp threads 18 and 19 in the "inter-leg" spaces 24 between each pair of elongated loops 14 and in a plane defined commonly by the lowermost surfaces of the lower legs 14*c*, with the results that the first group threads 18 and 19** are oriented to follow a deeply undulated path in the woven filament section $W_f$.

The continuous binding weft thread 22 is inserted substantially in a common plane defined by the uppermost surfaces of the upper legs **14*b* of the successive loops 14 and extends weftwise substantially the entire length of the leg portion 14*b*(14*c*) intermediate the coupling head 14*a* and the heel 14*d* in the spaces 24 between each adjacent pair of loops 14**.

The binding weft thread 22 passes around the binding warp thread 18 adjacent to the coupling head **14*a* and loops around the foundation weft 17 at a position interiorly of the heel portion 14*d* which interconnects the upper leg 14*b* of one loop with the lower leg 14*c* of a next adjacent loop of the filament 13**.

On its return trip, the binding weft thread 22 passes alternately over and under the binding warp threads 18–21 in the spaces between each adjacent pair of loops 14. The second group of binding warp threads 20 and 21 disposed between the thread 18 and the thread 19 are not interengaged with the foundation weft 17 but are interlaced only with the binding weft thread 22 in a plane nearly flush with the common plane of the upper legs **14*b* of the successive loops 14 so that the path of the binding threads 20 and 21 presents itself to be only slightly undulated as shown in FIG. 2. The binding weft thread 22 cooperates with the binding warp threads 18–21 in binding the upper legs 14*b* in particular against displacement and thus preventing the loops 14 of the filament 13 as a whole from moving out of alignment when the fastener is subjected to bending stresses. According to an important feature of the invention, the foundation warp threads 16' disposed centrally of the woven filament section $W_f$ and extending between the second group of binding warp threads 20 and 21 are, as distinct from the rest of the foundation warp threads 16, passed upwardly towards the upper legs 14*b* between each adjacent pair of loops 14 and interlaced with the binding weft thread 22 in substantially the same plane where the binding warp threads 18–21 are interlaced with the binding weft thread 22. The foundation warp threads 16' are each reversed around the binding weft thread 22 to interlace with the foundation weft 17 underlying the lower leg 14*c* of each loop 14 and continue to run along a deeply undulated path in each "inter-leg" space 24 very much the same way as the first group of binding threads 18, 19 run. This thread weave structure at the woven filament section $W_f$ provides firm support for the filament 13 and ensures maintenance of the correct loop-to-loop pitch of the row of elongated coupling loops 14 against bending stresses applied particularly laterally of the stringer 11. More specifically, the center portion of each loop 14 is supported in place by the foundation warp threads 16', while the outer portion of the loop 14 adjacent the coupling head 14*a* and the inner portion of the loop 14 adjacent the heel portion 14*d* are respectively supported by the binding warp threads 18 and 19. The arrangement that the binding warp threads 18 and 19 and the foundation warp threads 16' alike extend vertically between the binding weft 22 and the foundation weft 17 in each "inter-leg" space 24, provides resistance of the woven filament section $W_f$ to elongation in the event the stringer 11** is flexed transversely.

Another advantage accruing from the said arrangement is that a substantially functionally symmetric woven filament section $W_f$ on both sides of the stringer 11 is obtained to permit the same to be used optionally on either side.

Figure 4:
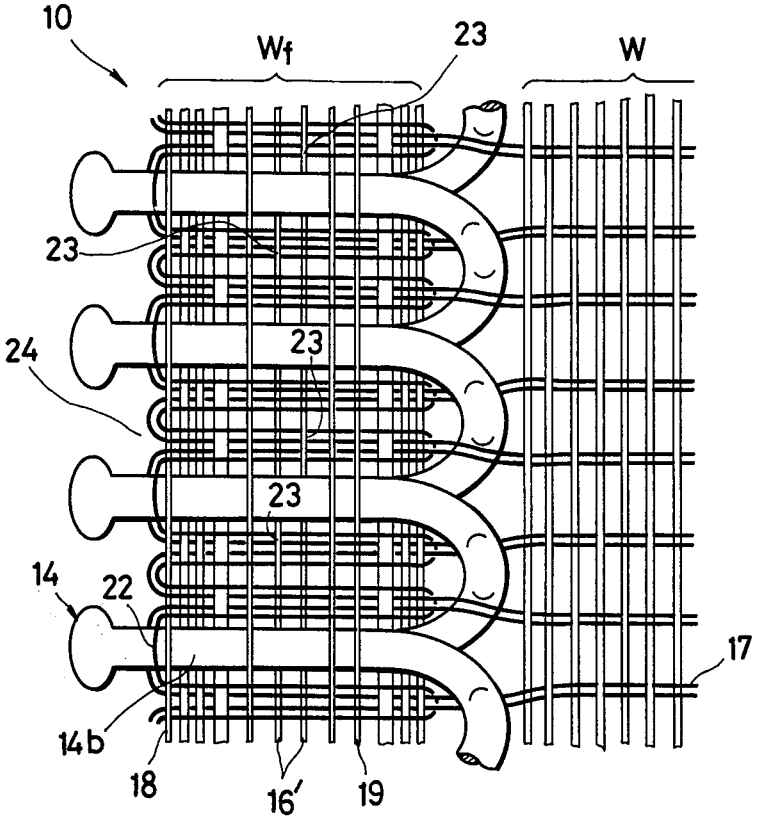
FIG. 4 is a view similar to FIG. 1 but showing another embodiment of the invention.
Figure 5:
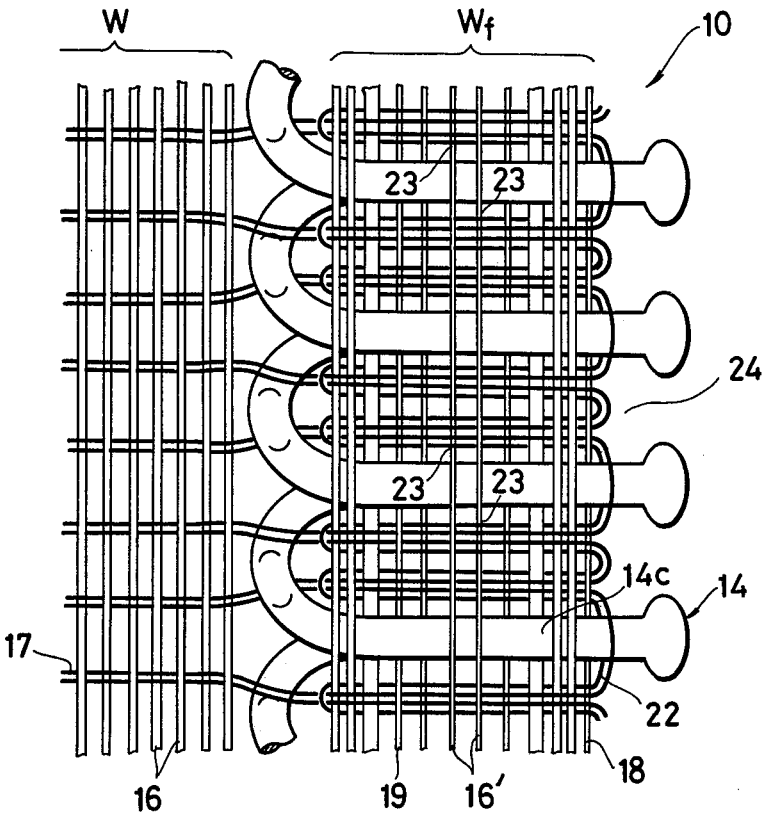
FIG. 5 is a view of the reverse side of the stringer shown in FIG. 4.

The second embodiment shown in FIGS. 4 and 5 is the same in all respects as the first embodiment which has been discussed, only except for a slight modification in the lay of the foundation warp threads 16'. It will be noted that a junction 23 of interlacing of these warp threads 16' with the binding weft thread 22 takes place in the "inter-leg" spaces 24 between every other pair of loops 14 of the filament 13; in other words, the threads 16' extend under the lower surfaces of the lower legs **14*c* of two successive loops 14 and come into interlaced engagement with the binding weft thread 22 in a next adjoining "inter-leg" space 24**. This arrangement is advantageous in that thread consumption is reduced.

Although various minor modifications may be suggested by those versed in the art, it should be understood that we wish to mebody within the scope of the patent warranted hereon, all such embodiments as reasonably and properly come within the scope of our contribution to the art.

What is claimed is:

1. A woven fastener stringer comprising a woven tape formed with foundation warp and weft threads and consisting of a web section defining a major dimension of said tape and a woven filament section defining a longitudinal edge portion of said tape; a row of successively interconnected elongated loops woven into said filament section, each of said loops having a coupling head at one end thereof, an upper leg and a lower leg extending from said head in a common direction and a heel portion at the opposite end remote from said head connected to a next adjacent one of said successive loops; a plurality of reinforcing cores extending longitudinally through said row of elongated loops; a binding weft thread extending substantially the full length of said leg between each adjacent pair of said loops; a first group of binding warp threads and a second group of binding warp threads both being interlaced with said binding weft thread substantially in a common plane defined by the upper surfaces of said upper legs, said first group of threads being further interlaced with said foundation weft thread underlying said lower legs of said loops, and one or more of said foundation warp threads in said woven filament section passing upwardly towards said upper legs and being interlaced with said binding weft thread.

2. A woven fastener stringer as defined in claim 1 wherein one of binding warp threads in said first group extends over said upper legs of said loop adjacent said coupling head and another thread in said first group extends over said upper legs of said loops adjacent said heel portion.

3. A woven fastener stringer as defined in claim 1 wherein said one or more of said foundation warp threads are interposed centrally of said loops between said second binding warp threads.

4. A woven fastener stringer as defined in claim 1 wherein said one or more of said foundation warp threads are arranged in symmetric relation to said binding warp threads in said first group to permit the stringer to be used optionally on either side.

* * * * *